US005200723A

United States Patent [19]

Fujihisa et al.

[11] Patent Number: 5,200,723

[45] Date of Patent: Apr. 6, 1993

[54] REMOTELY-CONTROLLED RELAY

[75] Inventors: Hiroaki Fujihisa; Manabu Sogabe, both of Hiroshima, Japan

[73] Assignee: Mitsubishi Denki Kabushiki Kaisha, Tokyo, Japan

[21] Appl. No.: 704,037

[22] Filed: May 22, 1991

[30] Foreign Application Priority Data

May 23, 1990 [JP] Japan ..... 2-133027

[51] Int. Cl.[5] ..... H01H 75/00

[52] U.S. Cl. ..... 335/14; 335/20

[58] Field of Search ..... 335/6, 14, 20

[56] References Cited

U.S. PATENT DOCUMENTS

Re. 32,882 3/1989 Yokoyama et al. .

4,623,859 11/1986 Erickson et al. .

4,897,625 1/1990 Yokoyama et al. ..... 335/14

5,053,735 10/1991 Ohishi et al. ..... 335/14

*Primary Examiner*—Lincoln Donovan

*Attorney, Agent, or Firm*—Burns, Doane, Swecker & Mathis

[57] ABSTRACT

A remotely controlled relay having a lever and a link, both of which being driven by a bistable polar electromagnet device. The lever drives a switch circuit to open and close while the link operates the main-circuit opening-and-closing assembly. A current is supplied to the coil of the bistable polar magnet device from an external circuit and magnetizes the plunger such that the plunger moves through a stroke between a first and second positions. When the plunger arrives at the center of its stroke while the plunger is moving from the first position to the second position, the lever causes the micro-switch to switch from the a first contact position to a second contact position. When the plunger arrives at the center of plunger stroke while the plunger is moving from the second position to the first position, the lever causes the micro-switch to switch from the second contact position to the first contact position.

3 Claims, 9 Drawing Sheets

REMOTELY-CONTROLLED RELAY

BACKGROUND OF THE INVENTION

The present invention relates to a remotely-controlled relay. FIG. 9 shows a conventional remotely-controlled relay. A micro-switch 18 is placed at position b shown in FIG. 10. A leaf spring 20 urges the actuator 21 of the switch 18 through an insulator 10. When an operating switch 40*a* is placed to the ON side, an operating current flows through a loop of diode 19*b*—coil 3—contact ON—D2—power source, so that the coil 3 produces a magnetic flux in such a direction as to weaken the flux of a permanent magnet 7. The magnetic flux produced by the coil 3 repels the attracting force of the fixed core 22 in abutment relation with a yoke 6 and attracts a plunger 8, as well as overcomes the force of a compressed spring 9 to release the plunger 8 to the left. Thus, the plunger 8 closes the contacts 11 and 14 of the main circuit. The insulator 10 releases the leaf spring 20, which in turn causes the switch 18 to be positioned to the position a in FIG. 10.

With the main circuit closed, when the switch 40*a* is placed to the OFF position, the operating current flows through a loop of D1—contact OFF—coil 3—diode 19*a*—power source, so that the coil 3 produces a magnetic flux in such a direction as to strengthen the flux of a permanent magnet 7. This magnetic flux increases the attracting force of the yoke that attracts the plunger 8, and overcomes the repulsive spring of a compressed force 9 to move the plunger 8 to the right, thus opening the contacts 11 and 14 of the main circuit. The insulator 10 again drives the leaf spring 20 so that the switch 18 is again positioned to the position a in FIG. 10. With this type of bistable polar electromagnet device, the stroke of movement of the plunger determines the gap between the main contacts when they are opened. However, the larger the stroke, the higher the operating current required.

SUMMARY OF THE INVENTION

An object of the invention is to provide a remotely-controlled relay in which only a small stroke of a plunger is required to open and close the main circuit.

Another object of the invention is to provide a remotely controlled relay that requires only a small operating current for magnetizing the relay coil to drive the plunger.

A remotely controlled relay according to the present invention has a lever and a link, both driven by a bistable polar electromagnet device.

The lever drives a switch circuit to open and close while the link operates the main-circuit opening and closing assembly. A current is supplied to the coil of the bistable polar magnet device from an external circuit and magnetizes the plunger such that the plunger moves through a stroke between a first and a second position. When the plunger arrives at the center of its stroke while moving from the first position to the second position, the lever causes the micro-switch to switch from the a first contact position to a second contact position.

When the plunger arrives at the center of plunger stroke while moving from the second position to the first position, the lever causes the micro-switch to switch from the second contact position to the first contact position.

BRIEF DESCRIPTION OF THE DRAWINGS

Features and other objects of the invention will be more apparent from the description of the preferred embodiments with reference to the accompanying drawings in which.

DETAILED DESCRIPTION OF THE EMBODIMENTS

Figure 1:
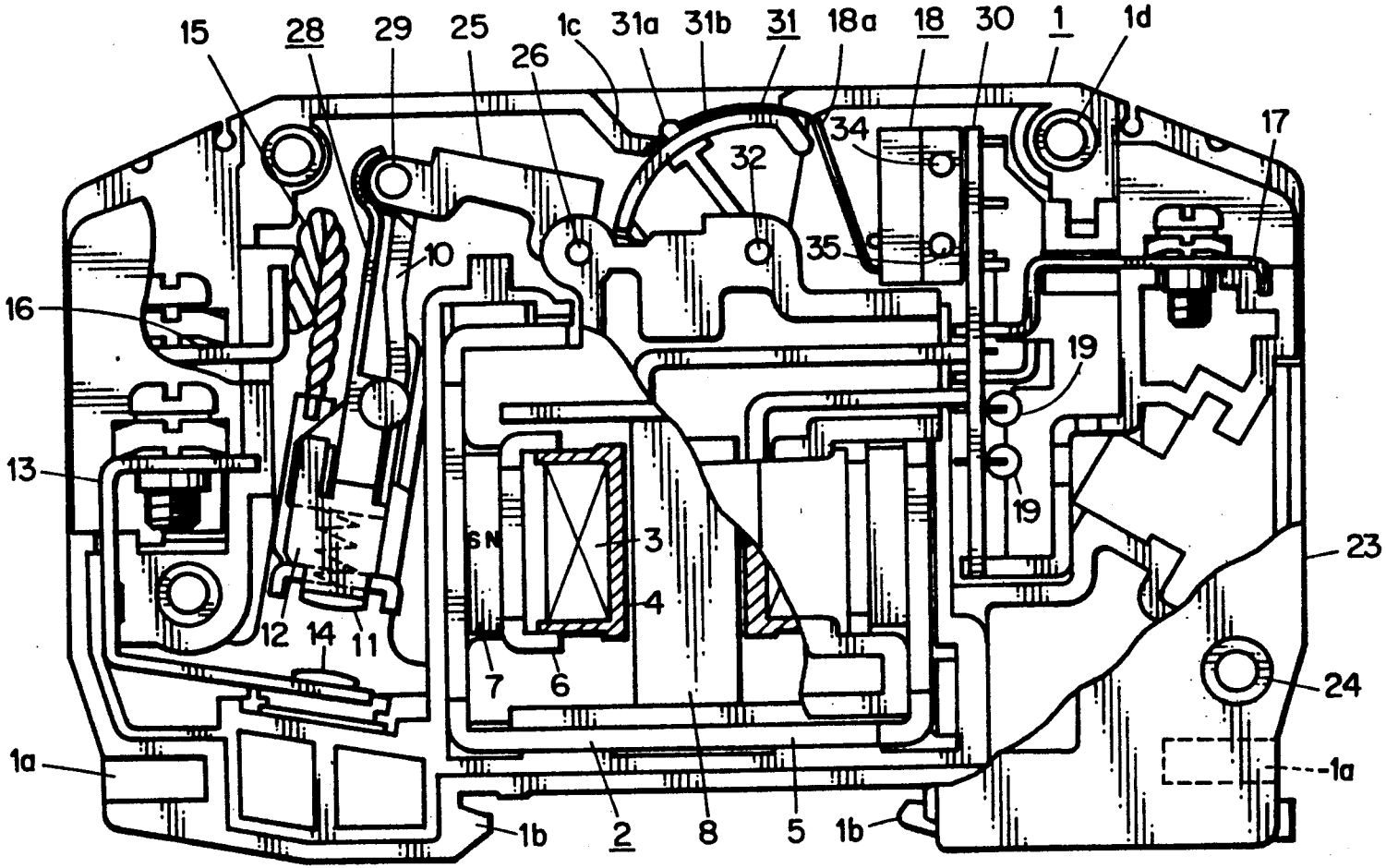
FIG. 1 is a general side view of a remotely-controlled relay according to the invention when the main circuit is open.
Figure 2:
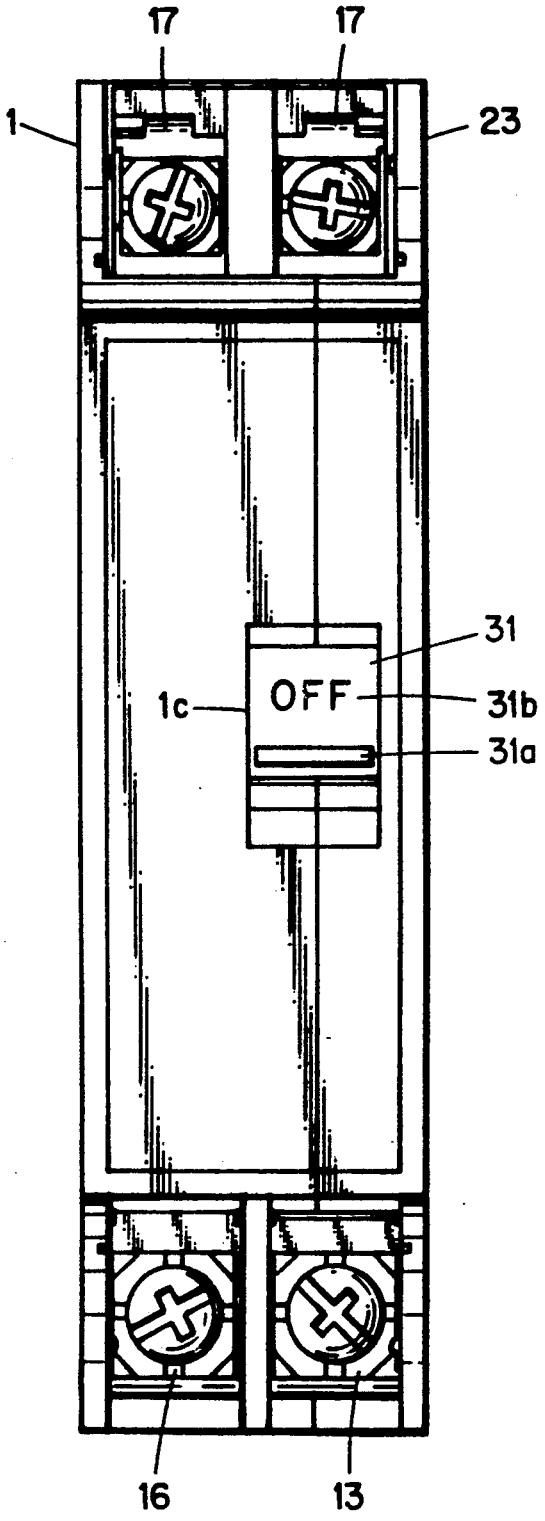
FIG. 2 is a top view of FIG. 1.
Figure 3:
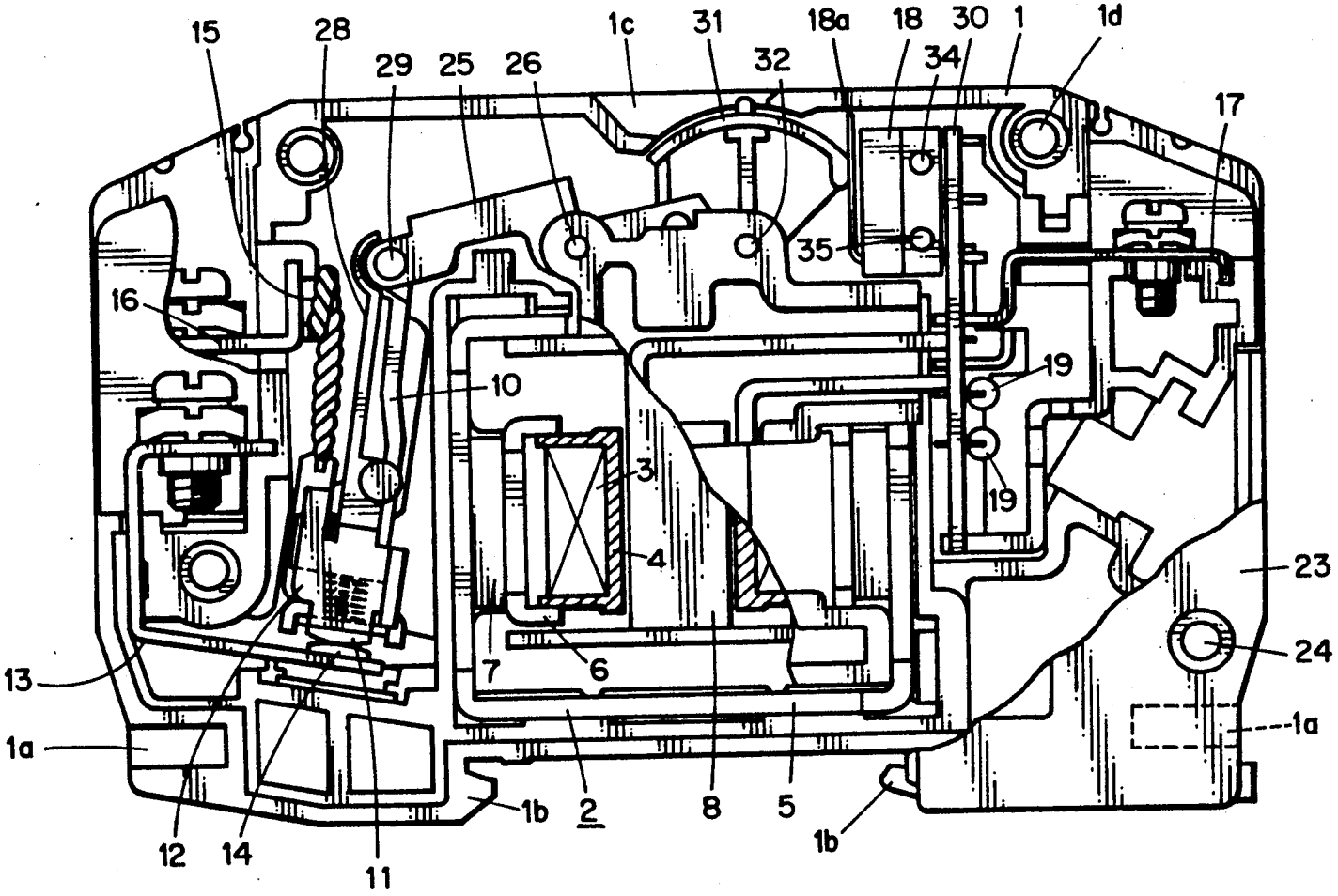
FIG. 3 is a general side view of a remotely-controlled relay according to the invention when the main circuit is closed.

An embodiment of the present invention will now be described in detail with reference to the drawings. FIG. 1 is a general side view of a remotely-controlled relay according to the invention. FIG. 2 is a top view of a relevant portion of FIG. 1. FIG. 3 is a top view of FIG. 4.

A housing consists of a base 1 and a cover 23 which are riveted together at four locations by rivets. The housing has grooves 1*a* into which mounting angles are inserted, projections by 1*b* by which the relay is mounted on DIN rails, and an aperture 1*c* at the top of the housing.

Figure 5:
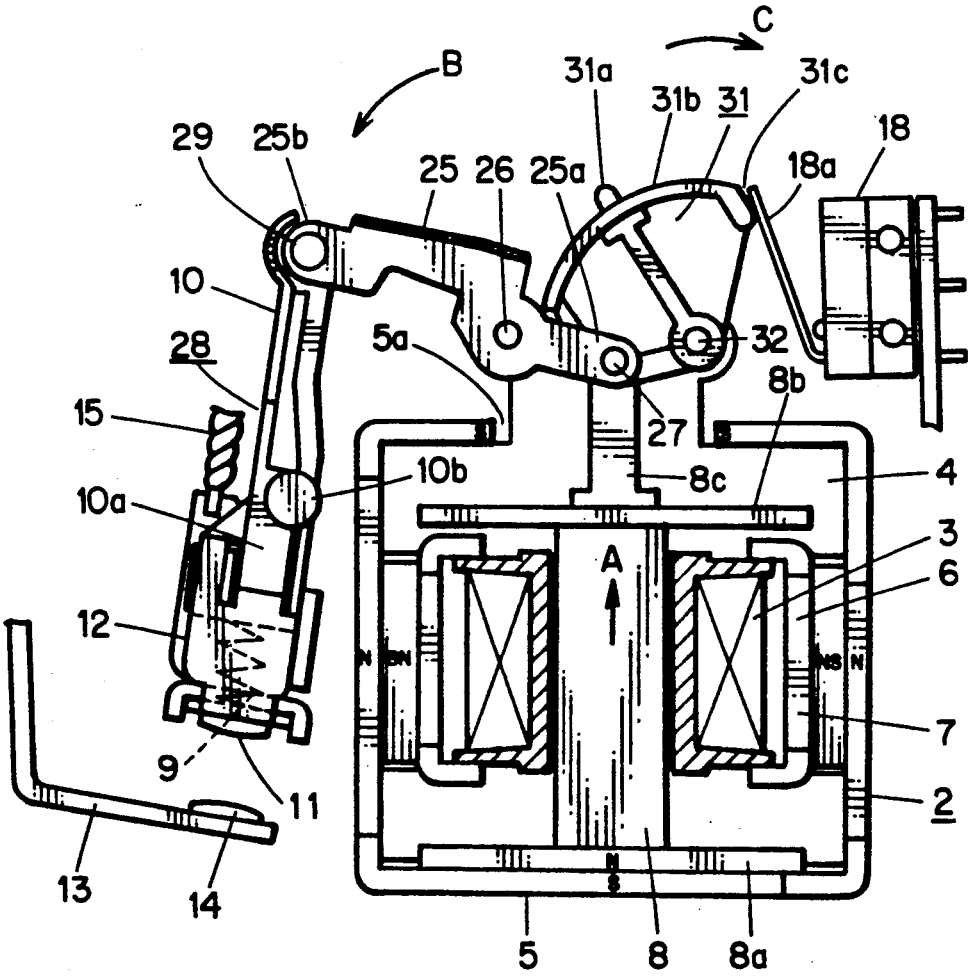
FIG. 5 shows the relevant portion of FIG. 1 when the main circuit is opened.
Figure 6:
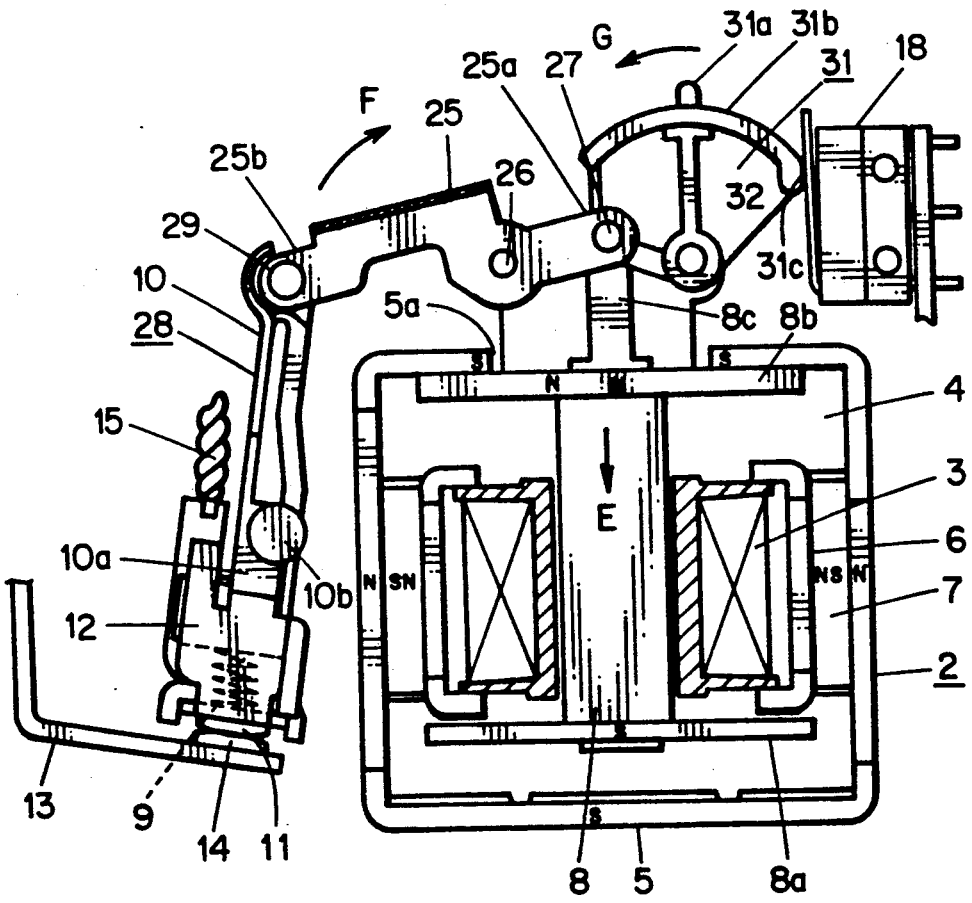
FIG. 6 shows the relevant portion of FIG. 3 when the main circuit is closed.

An electromagnet device 2 is of a bistable polar type having two stable positions where a plunger 8 is securely attracted by a magnet, and is provided in the middle of the base 1. As shown in FIG. 1, a coil 3 is wound about a bobbin 4, shown hatched, through which the plunger 8 slidably extends. The plunger 8 acts as an armature having a top end 8*a* and a bottom end 8*b*, attracted by a yoke 5 magnetized by permanent magnets 7. As shown in FIGS. 5–6, the bobbin 4 and the plunger 8 are housed in a first yoke 5, and the plunger 8 extends at its distal end 8*c* through an aperture 5*a* outwardly of the yoke 5. On the inner wall of the yoke 5 is provided the permanent magnets 7. A second yoke 6 having a generally U-shaped cross section is mounted between the permanent magnet 7 and bobbin 4 such that the yoke 6 abuts the magnet 7 and holds the bobbin 4. A link 25 is pivotally mounted on the base 1 by means of a pin 26, and is pivotally connected at one end 25*a* thereof through a pin 27 to the plunger distal end 8*c* and at the other end 25*b* through a pin 29 to an insulator 10 of a movable-contact assembly 28. It should be noted that the distance between the pins 26 and 27 is selected to be shorter than that between the pins 26 and 29, so that the displacement of the link 25 at the end 25*a* is amplified at the end 25*b*. The insulator 10 is formed with a groove 10*a* therein in which a movable piece 12 slides.

The movable piece 12 has a contact 11 which is electrically connected with a terminal 16 of the main circuit by means of a shunt 15. The contact 11 is provided with a compression spring 9 that urges the contact 11 against a fixed contact 14 on a terminal 13 of the main circuit. The movable-contact assembly 10 and the contacts 11 and 14 form a main-circuit-opening and closing assembly. A pin 10*b* mounted to the insulator 10 loosely engages and is guided by a groove(not shown) in the base 1 and a groove(not shown) in the cover 23 so that the movable-contact assembly 28 is operatively driven by the plunger 8 to close and open the contacts 11 and 14.

Figure 4:
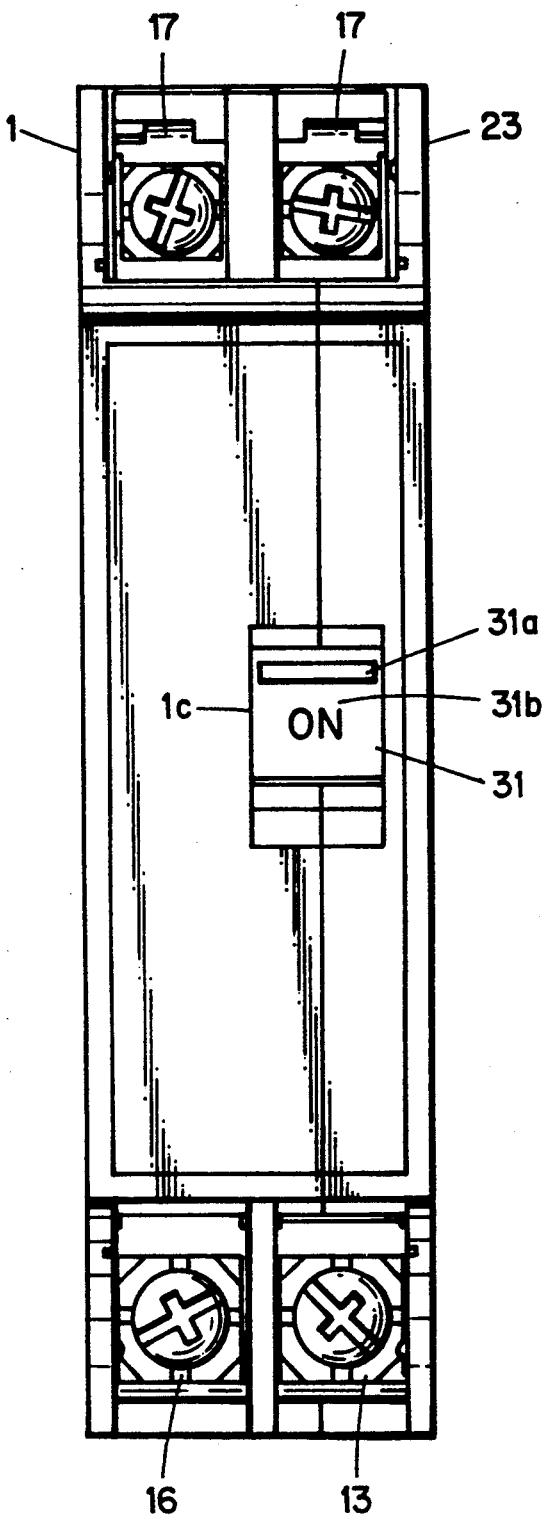
FIG. 4 is a top view of FIG. 1.

The operating lever 31 is pivotally mounted to the base 1 by means of a pin 32 and is pivotally connected to the tip end 8*c* by means of a pin 27. The operating lever 31 pivots about the pin 32 when the plunger 8 moves up and down. The operating lever 31 has a handle 31*a* facing the aperture 1*c* for manually operating the lever 31. On both sides of the handle 31*a* is provided a display 31*b* that indicates ON and OFF states of the contacts 11 and 14 as shown in FIGS. 2 and 4. When the operating lever 31 rotates about the pin 32, a projection 31*c* engages the actuator 18*a* of the micro-switch 18 to open and close the switch 18.

Figure 7:
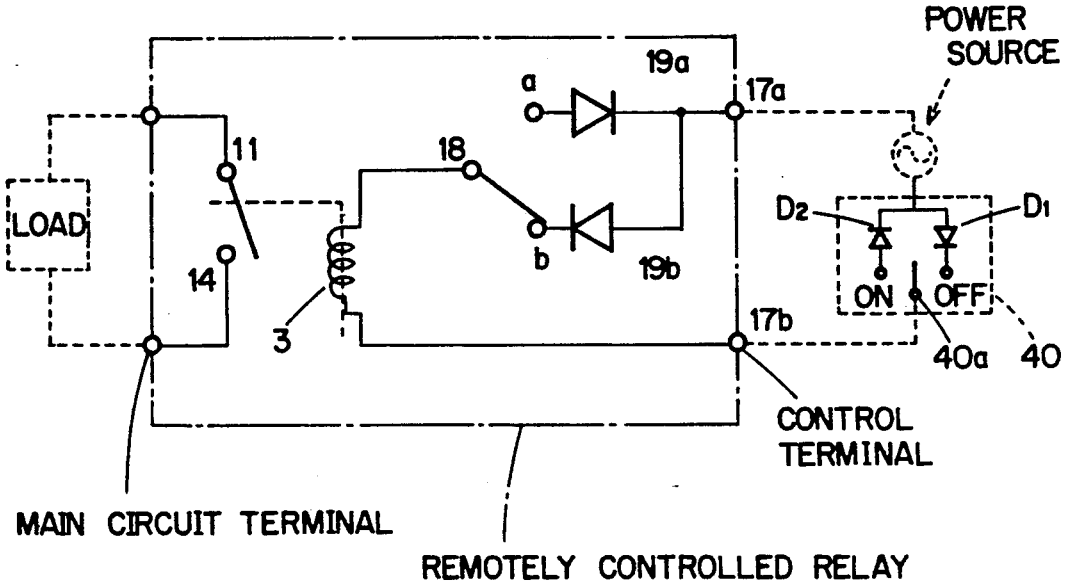
FIG. 7 shows the electrical circuit of the remotely controlled relay of FIG. 1.

FIG. 7 shows the electrical circuit of the remotely-controlled relay in FIG. 1. One end of the coil 3 is connected to a control terminal 17*b* and the other to the common terminals of the micro-switch 18. The contact a of the micro-switch 18 is connected with the anode of a diode 19*a*, and the contact b to the cathode of a diode 19*b*. The cathode of diode 19*a* and the anode of diode 19*b* are connected together to a control terminal 17*a*. Between the terminals 17*a* and 17*b* is remotely connected an external series connection of a power source and an operating switch 40 that includes diodes D1 and D2 and a normally-open single-pole-double-throw switch 40*a*.

OPERATION

OFF-to-ON Operation

Figure 8:
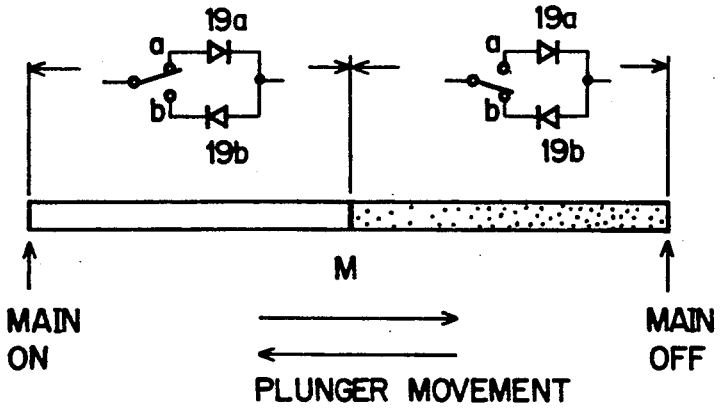
FIG. 8 illustrates the relationship between the movement of plunger through its stroke and the timing at which the micro-switch is switched by the plunger.
Figure 9:
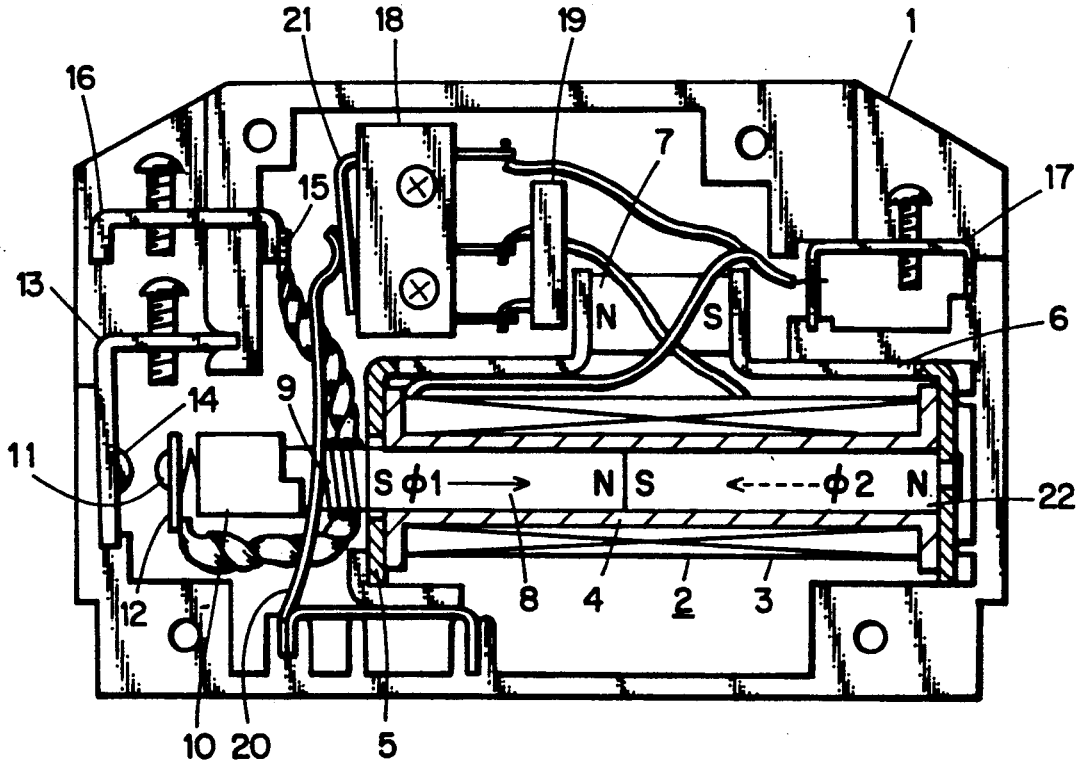
FIG. 9 shows a prior art remotely-controlled relay.
Figure 10:
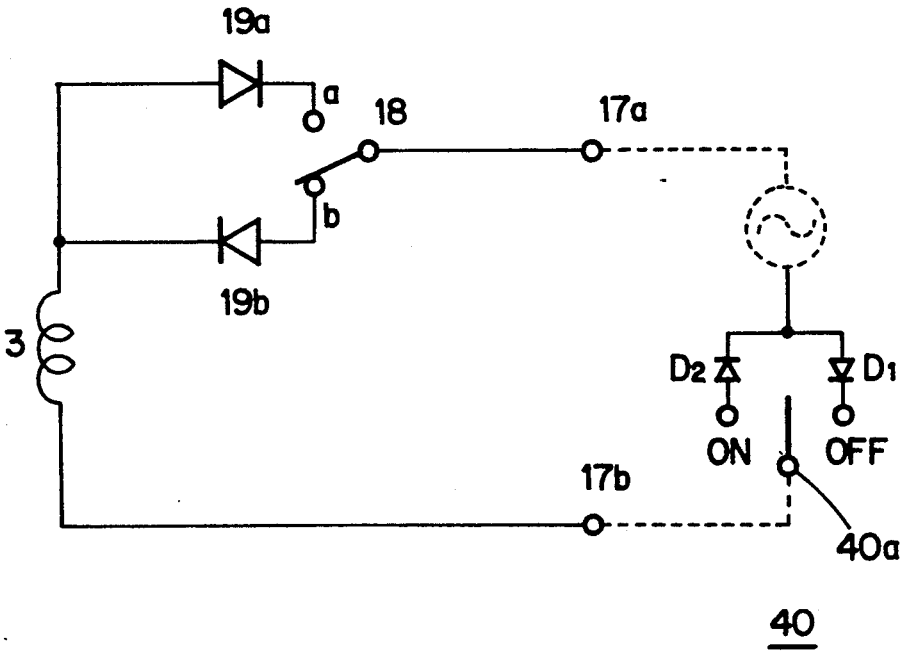
FIG. 10 shows the electrical circuit of the remotely controlled relay in FIG. 9.

FIG. 1 is a general side view of a remotely-controlled relay according to the invention when the main circuit is open. FIG. 8 illustrates the relationship between the position of plunger 8 in a stroke thereof and the timing at which the micro-switch 18 is switched. As shown in FIGS. 1 and 5, the bottom end 8*a* of plunger 8 is at the bottom of the yoke 5, securely attracted by the yoke 5. The display "OFF" appears in the aperture 1*c* as shown in FIG. 2. When the switch 40*a* is switched to the position ON, an ON-operating current flows in the loop of diode 19*b*—coil 3—contact ON—D2—power source. The coil 3 magnetizes the plunger 8 in a direction opposite to the magnetic poles shown in FIGS. 1 and 5, so that the plunger 8 repels the S pole of the bottom of yoke 5 and is driven in the direction of A in FIG. 5 to move to a center point M of the plunger stroke in FIG. 8, causing the link 25 to rotate in the direction of B and operating lever 31 in the direction of C. At this time, the operating lever 31 engages at 31*c* the actuator 18*a* to drive the micro-switch 18 from the contact b to contact a. At this time, the operating-current path changes from the loop of diode 19*b*—coil 3—contact ON—D2—power source to the loop of diode 19*a*—power source—D2—contact ON—coil 3, so that even if the operator continues to depress the switch 40*a* to the ON side, no current flows in the coil 3. Thus, the coil 3 no longer produces a force to drive the plunger 8. The plunger 8 is now sufficiently close to the upper end of yoke 5 to be attracted towards the upper end of the yoke 5 and stops at the position shown in FIG. 6 closing the contacts 11 and 14.

ON-to-OFF Operation

FIG. 3 shows a remotely-controlled relay when the main circuit is closed. The top end 8*b* of plunger 8 is at the top end of yoke 5, securely attracted by the yoke 5. In FIG. 7, when the switch 40*a* is switched to the position OFF, an OFF-operating current flows in the loop of D1—contact OFF—coil 3—contact a—diode 19*a*—power source. The coil 3 magnetizes the plunger 8 to polarities opposite to those shown in FIG. 6, so that the plunger 8 repels the S pole of the upper end of yoke 5 and is driven in the direction of E to move to the center point M in FIG. 8, causing the link 25 to rotate in the direction of F and operating lever 31 in the direction of G. At this time, the operating lever 31 acts at 31*c* on the actuator 18*a* so as to switch from the contact a to b. At this time, the operating-current path changes from the loop of D1—contact OFF—coil 3—contact a—diode 19*a*—power source to a loop of D1—contact OFF—coil 3—contact b—diode 19*b*—power source, so that even if the operator continues to depress the switch 40*a* to the OFF side, no current flows in the coil 3. Thus, the coil 3 no longer produces a force to drive the plunger 8. Since the plunger 8 is now sufficiently close to the bottom of yoke 5, the plunger 8 is attracted towards the bottom of yoke 5 and then stops at the position shown in FIGS. 1 and 5, opening the contacts 11 and 14. In this manner, the contacts 11 and 14 are opened. The display "OFF" now appears in the aperture 1*c* as shown in FIG. 2.

What is claimed is:

1. A remotely-controlled relay comprising a bistable polar electromagnet device a main-circuit opening-and-closing assembly driven by said bistable polar electromagnet device;

a housing for housing said bistable polar electromagnet device and said main-circuit opening-and-closing assembly; wherein said bistable polar electromagnet device includes;

a coil energized selectively in a first direction and in a second direction by a current supplied from an external circuit;

a switch circuit connected with said coil and selectively forming a first current path in which said coil is energized in said first direction and a second current path in which said coil is energized in said second direction;

a plunger magnetized by said coil such that said plunger moves through a stroke between a first position and a second position, said plunger moving to said first position when said coil is energized in said first direction and moving to said second position when said coil is energized in said second direction;

a lever pivotally supported by said housing and driven by said plunger to pivot, said lever driving said switch circuit to form said first current path when said plunger arrives at a center of said stroke during the time when said plunger moves from said second position to said first position, said lever driving said switch circuit to form said second current path when said plunger arrives at said center of said stroke during the time when said plunger moves from said first position to said second position, a link having a first end driven by said plunger and a second end connected to said main-circuit opening-and-closing assembly, and pivotally supported by said housing at an intermediate position between said first end and said second end, said link causing said main-circuit opening-and-closing assembly to close when said plunger moves to said first position and to open when said plunger moves to said second position.

2. A remotely-controlled relay according to claim 1, wherein said switch circuit includes;

a micro-switch having a first contact and a second contact;

a first diode whose cathode is connected with said first contact;

a second diode whose anode is connected with said second contact and whose cathode is connected with the anode of said first diode; whereby said switch circuit forms said first current path when said first contact is selected, and said second current path when said second contact is selected.

3. A remotely-controlled relay according to claim 1, wherein said link is pivotally supported by said housing at a position closer to said first end than to said second end.

* * * * *